US010090130B2

(12) United States Patent
Torai

(10) Patent No.: US 10,090,130 B2
(45) Date of Patent: Oct. 2, 2018

(54) MAGNETRON AND METHOD OF ADJUSTING RESONANCE FREQUENCY OF MAGNETRON

(71) Applicant: HITACHI POWER SOLUTIONS CO., LTD., Hitachi-shi, Ibaraki (JP)

(72) Inventor: Reiji Torai, Hitachi (JP)

(73) Assignee: HITACHI POWER SOLUTIONS CO., LTD., Hitachinaka-Shi, Ibaraki (JP)

( * ) Notice: Subject to any disclaimer, the term of this patent is extended or adjusted under 35 U.S.C. 154(b) by 0 days.

(21) Appl. No.: 15/593,388

(22) Filed: May 12, 2017

(65) Prior Publication Data

US 2017/0330721 A1 Nov. 16, 2017

(30) Foreign Application Priority Data

May 13, 2016 (JP) ..... 2016-097158

(51) Int. Cl.
*H01J 23/00* (2006.01)
*H01J 25/50* (2006.01)

(52) U.S. Cl.
CPC ..... *H01J 23/00* (2013.01); *H01J 25/50* (2013.01)

(58) Field of Classification Search
None
See application file for complete search history.

(56) References Cited

U.S. PATENT DOCUMENTS 3,553,524 A * 1/1971 Hill ..... H01J 23/22 315/39.69
5,146,136 A * 9/1992 Ogura ..... H01J 23/22 315/39.69
6,670,761 B1 * 12/2003 Lee ..... H01J 23/22 315/39.51
2002/0043937 A1 * 4/2002 Ogura ..... H01J 23/005 315/39.51

* cited by examiner

*Primary Examiner* — Jany Richardson
(74) *Attorney, Agent, or Firm* — Volpe and Koenig, P.C.

(57) ABSTRACT

Provided are a magnetron whose resonance frequency is easily adjusted and a method of adjusting a resonance frequency of the magnetron. A magnetron includes an anode cylinder extending in a cylindrical shape along a central axis, a plurality of tabular vanes each having at least one end fixed to the anode cylinder and extending toward the central axis from an inner surface of the anode cylinder, and pressure-equalizing rings disposed coaxially with respect to the central axis of the anode cylinder, and alternately electrically connecting the tabular vanes to each other. The tabular vanes have protrusions facing the pressure-equalizing rings in an axial direction of the anode cylinder, and notches serving as base points for deforming the protrusions toward the pressure-equalizing rings sides or opposite sides thereto.

10 Claims, 9 Drawing Sheets

【Fig.1】
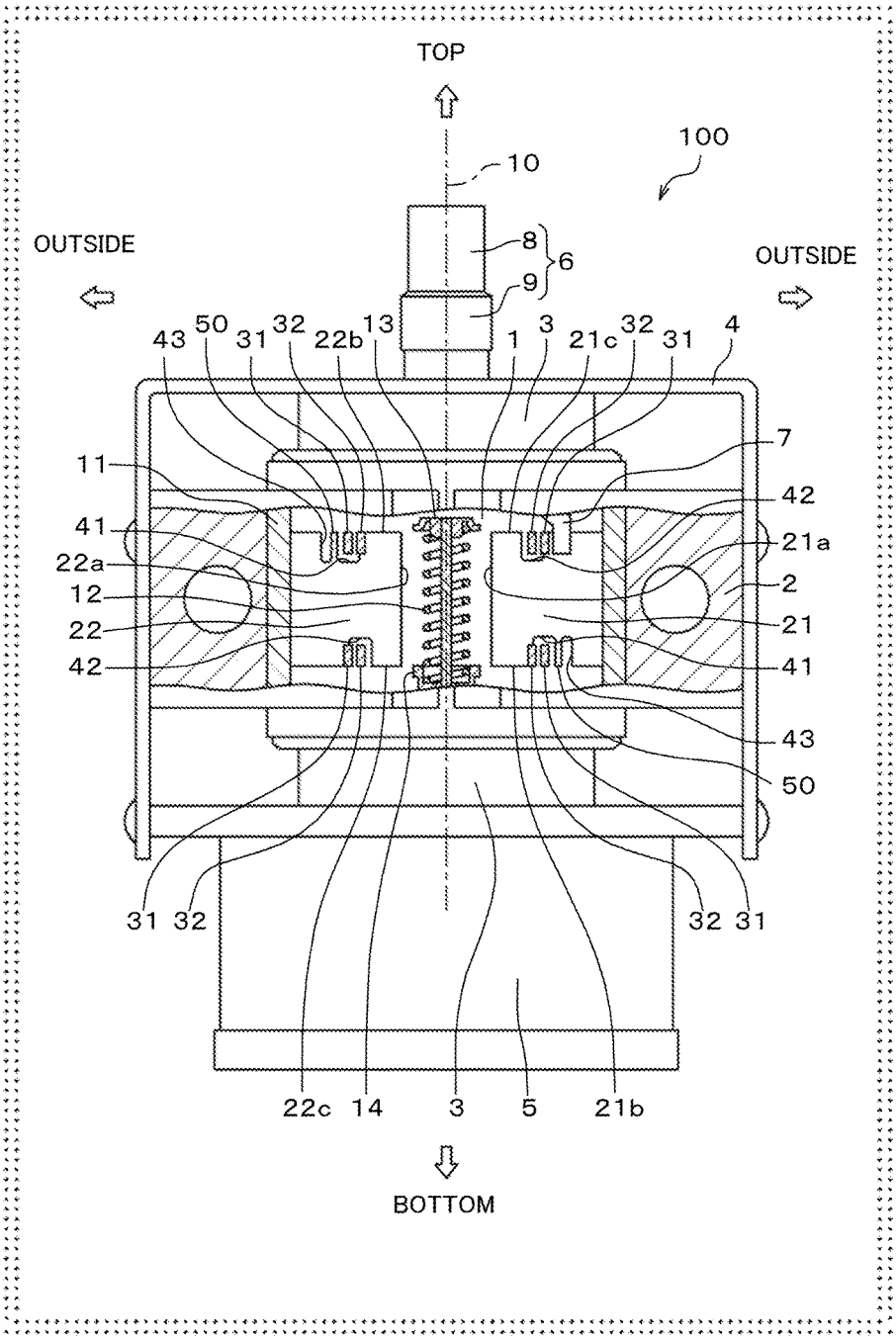

【Fig.2】
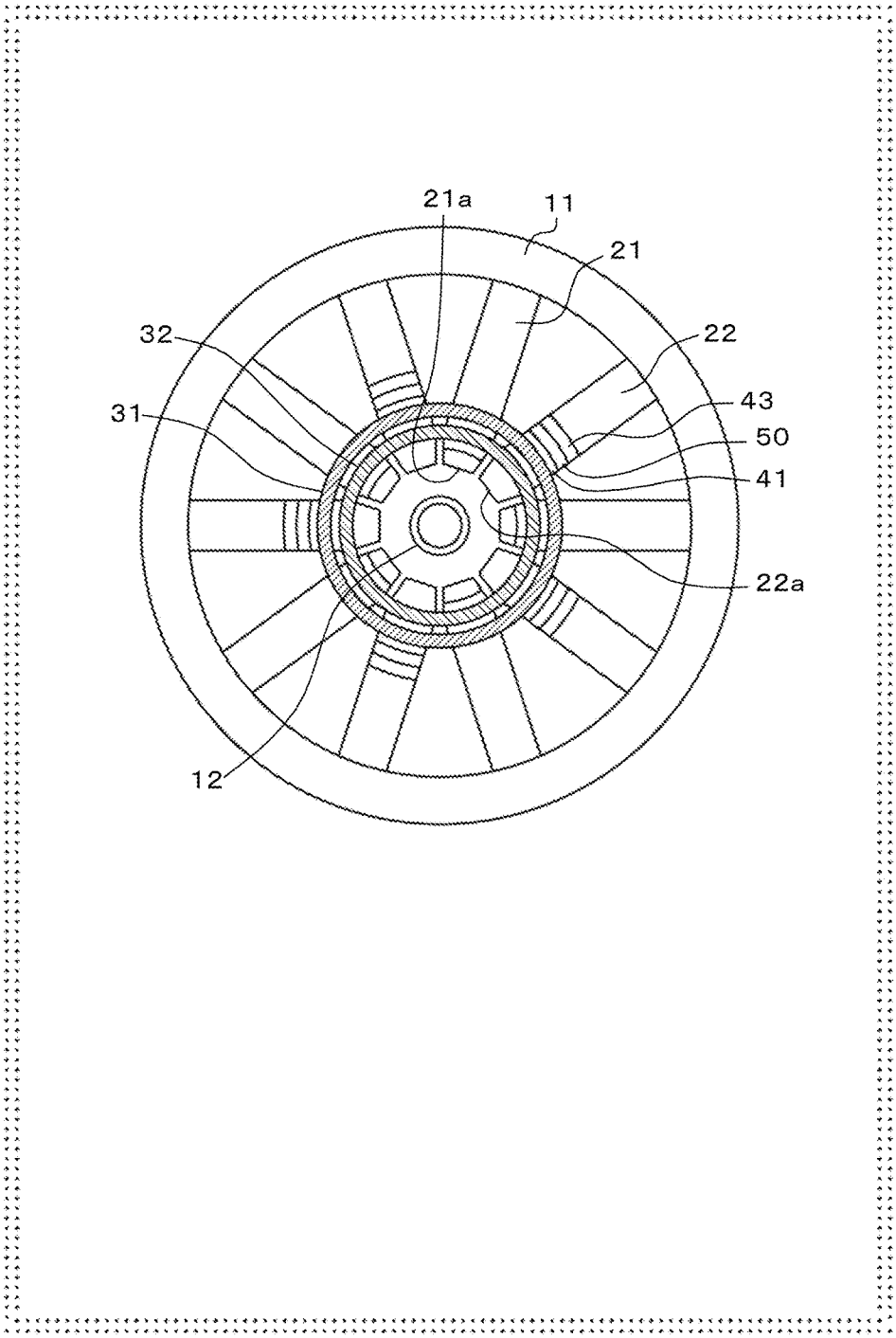

【Fig.3】
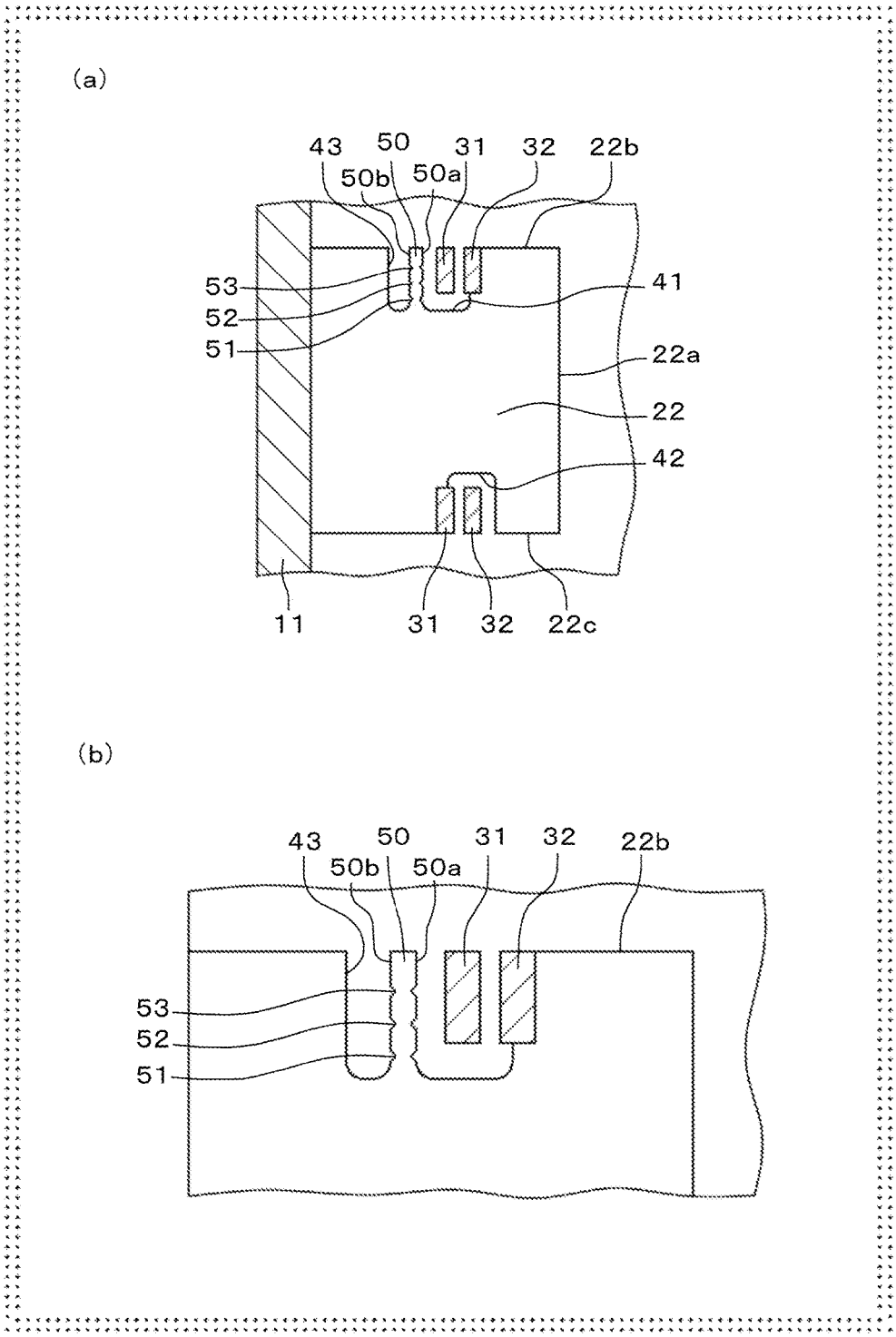

【Fig.4】
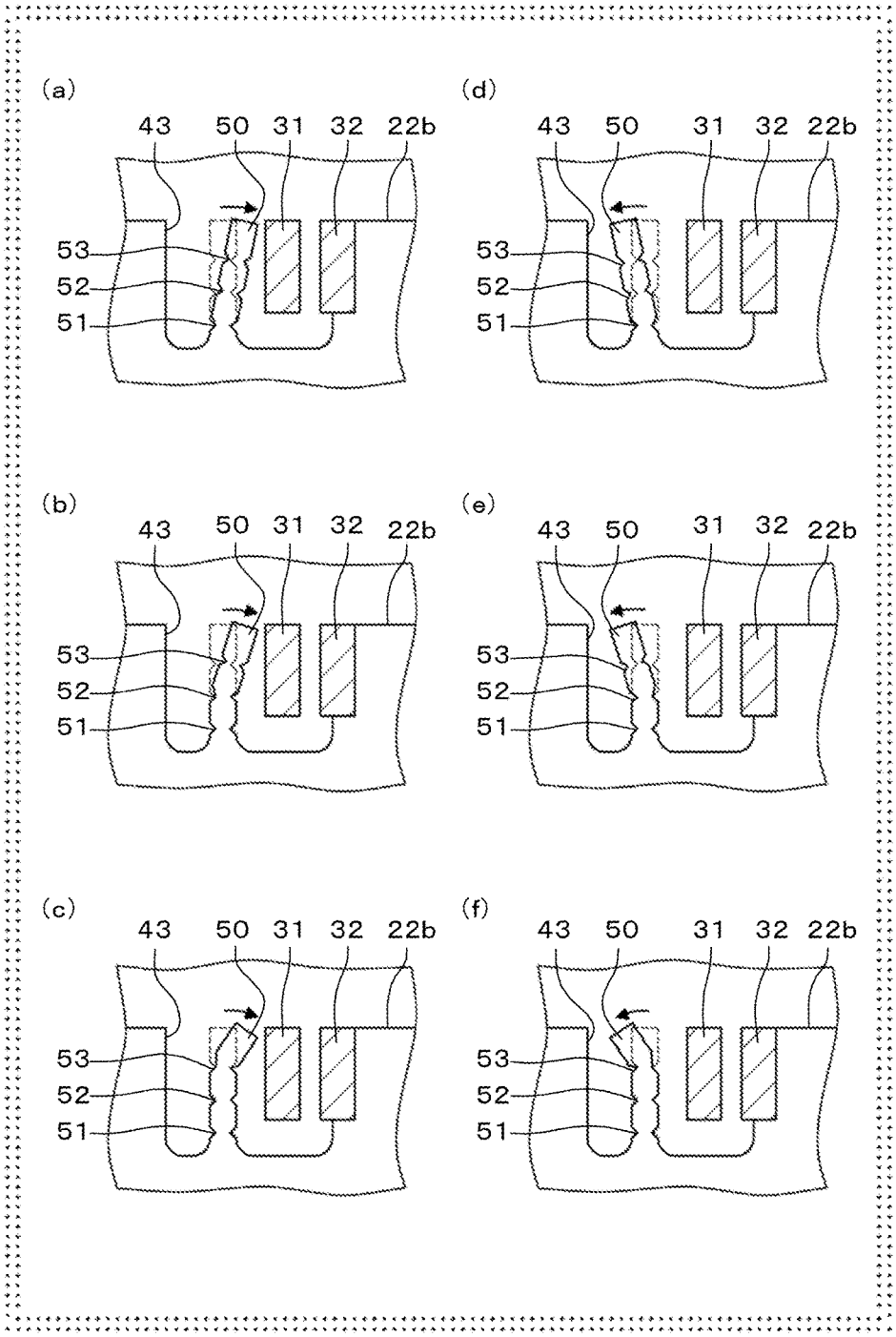

【Fig.5】
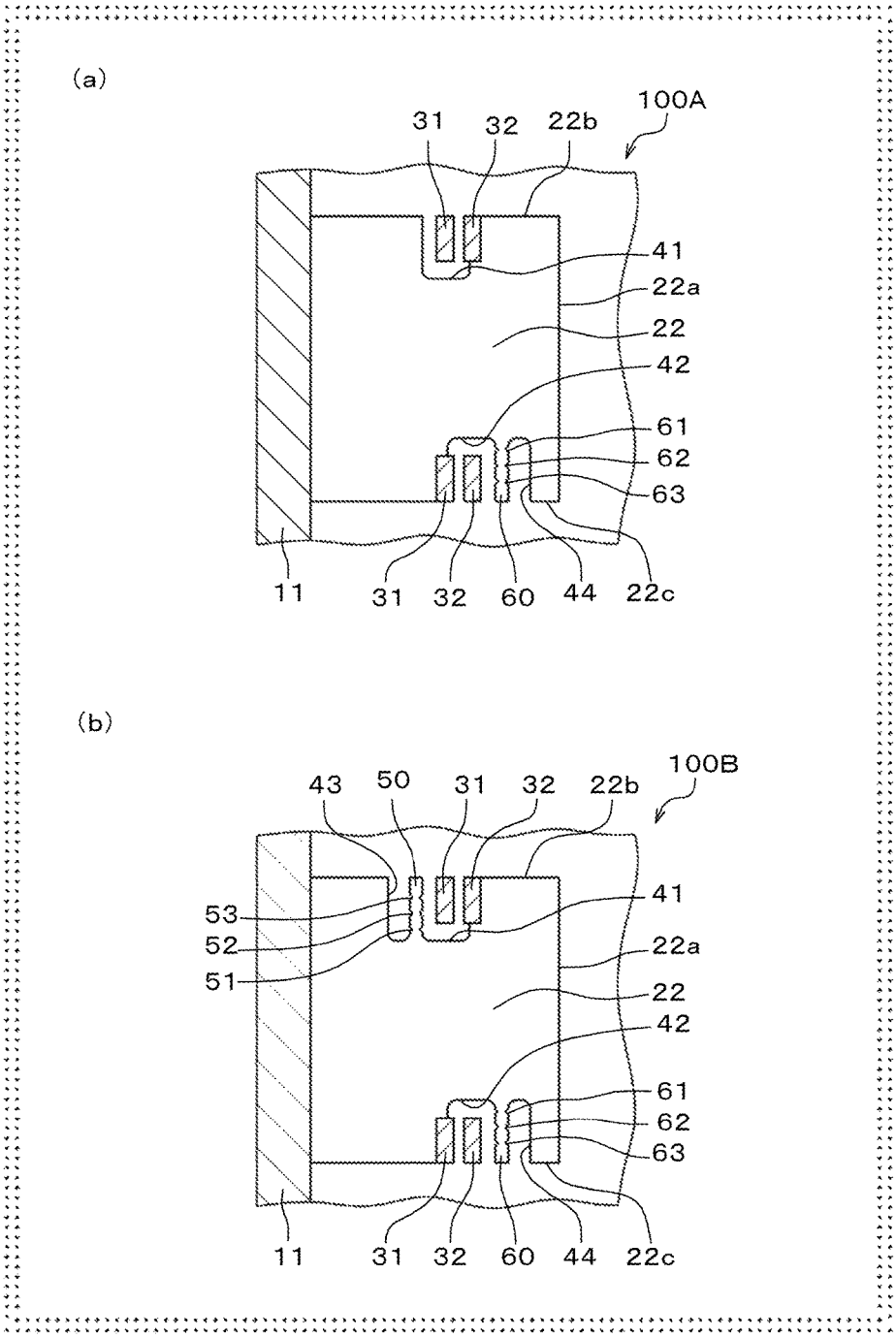

【Fig.6】
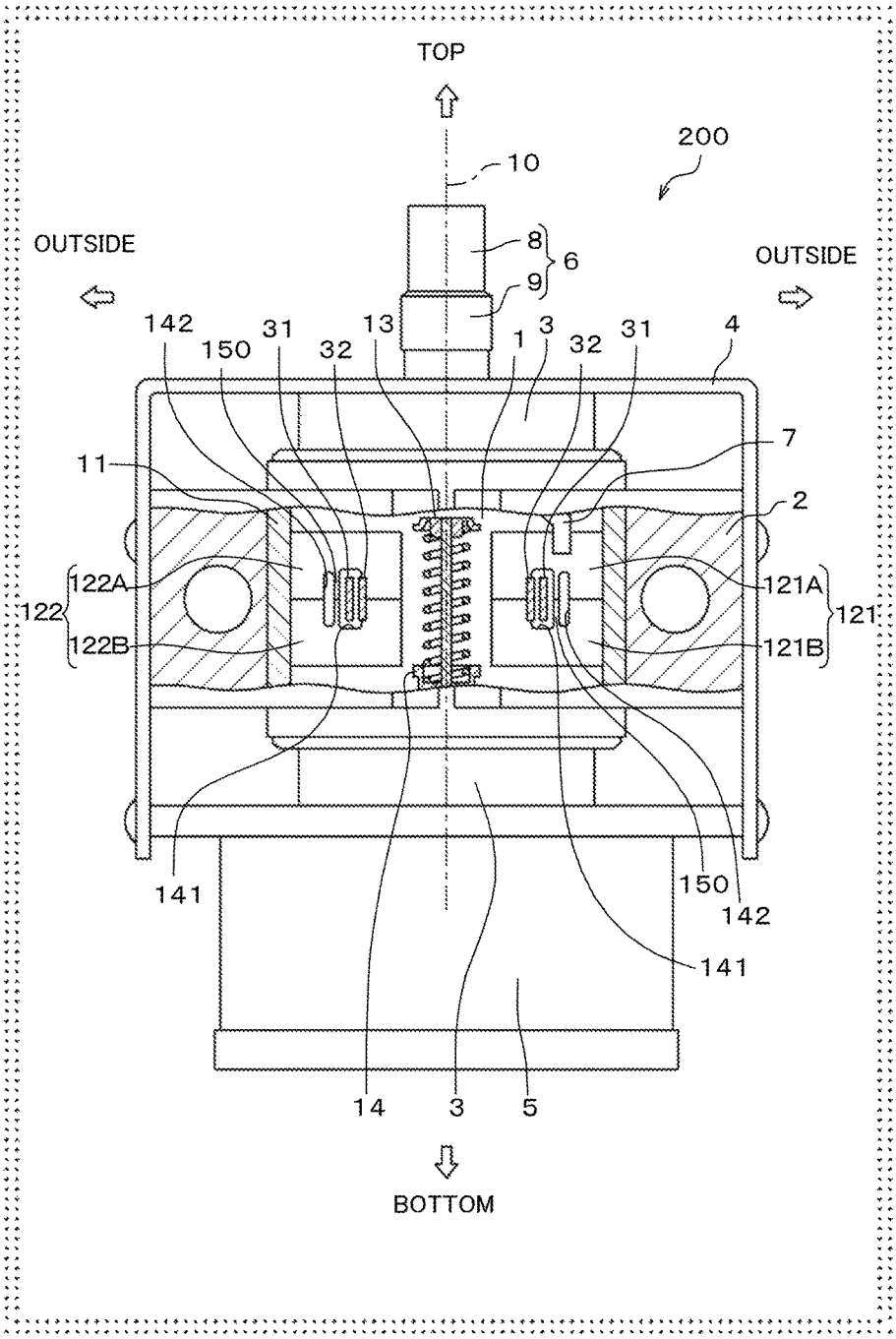

【Fig.7】
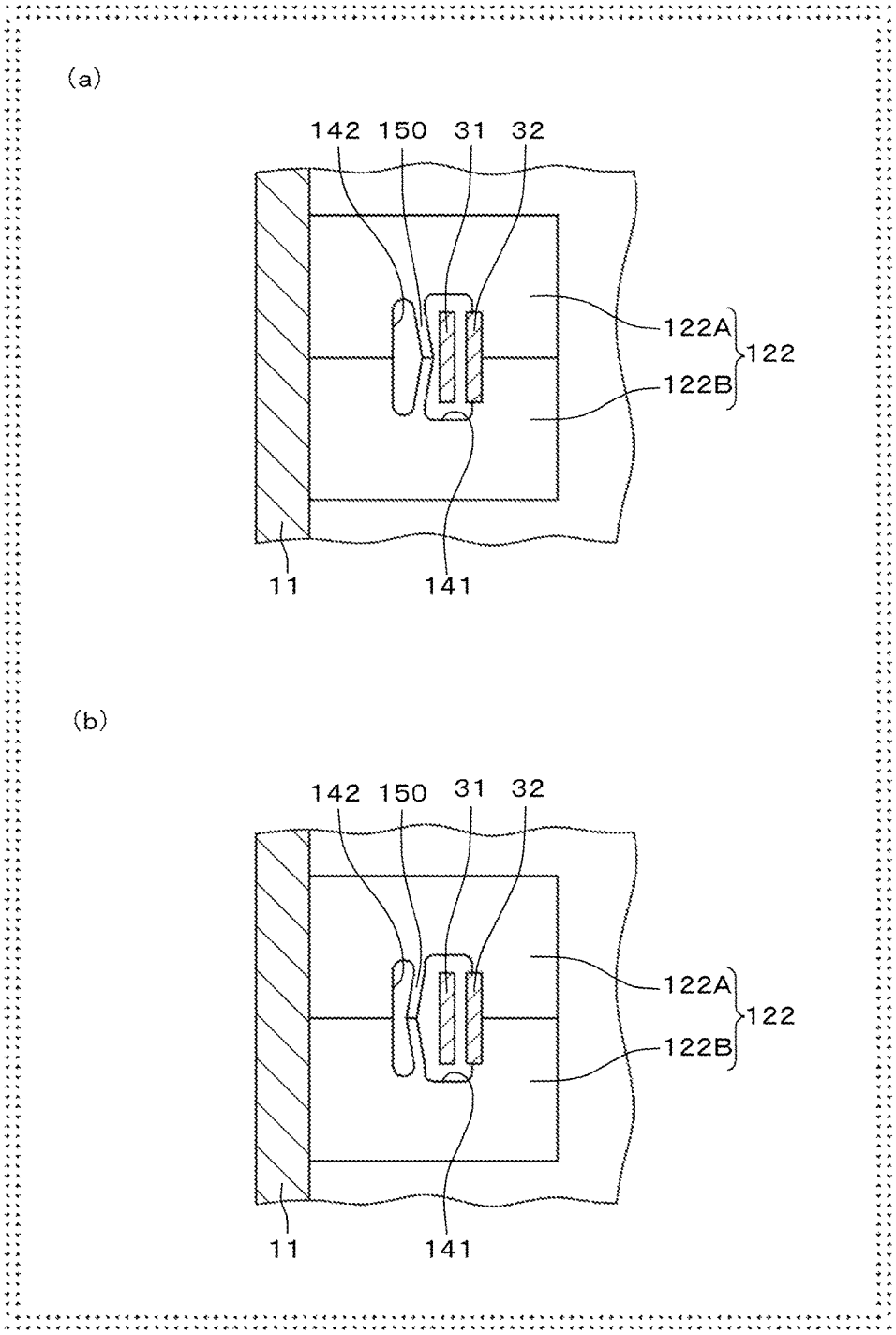

【Fig.8】
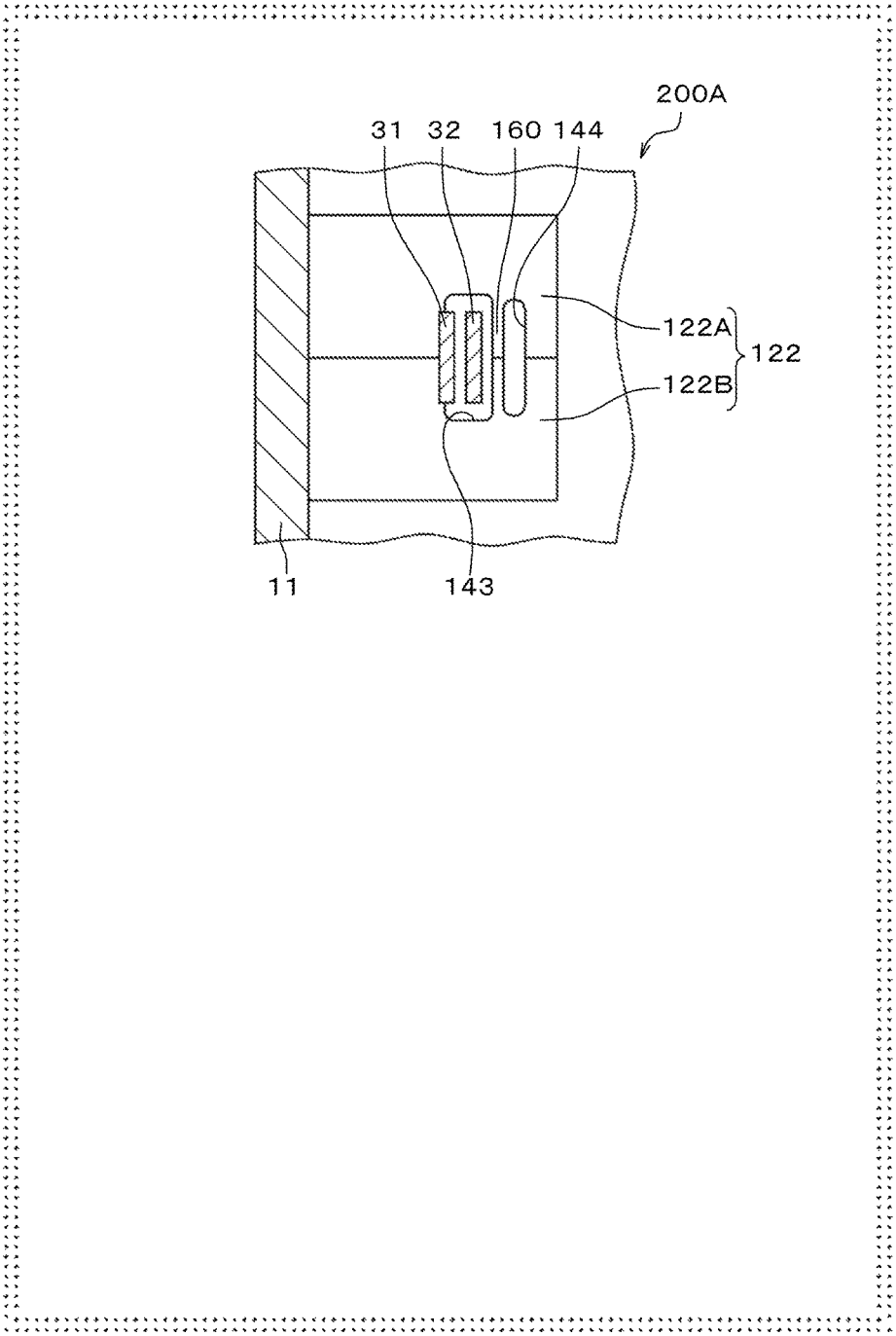

【Fig.9】
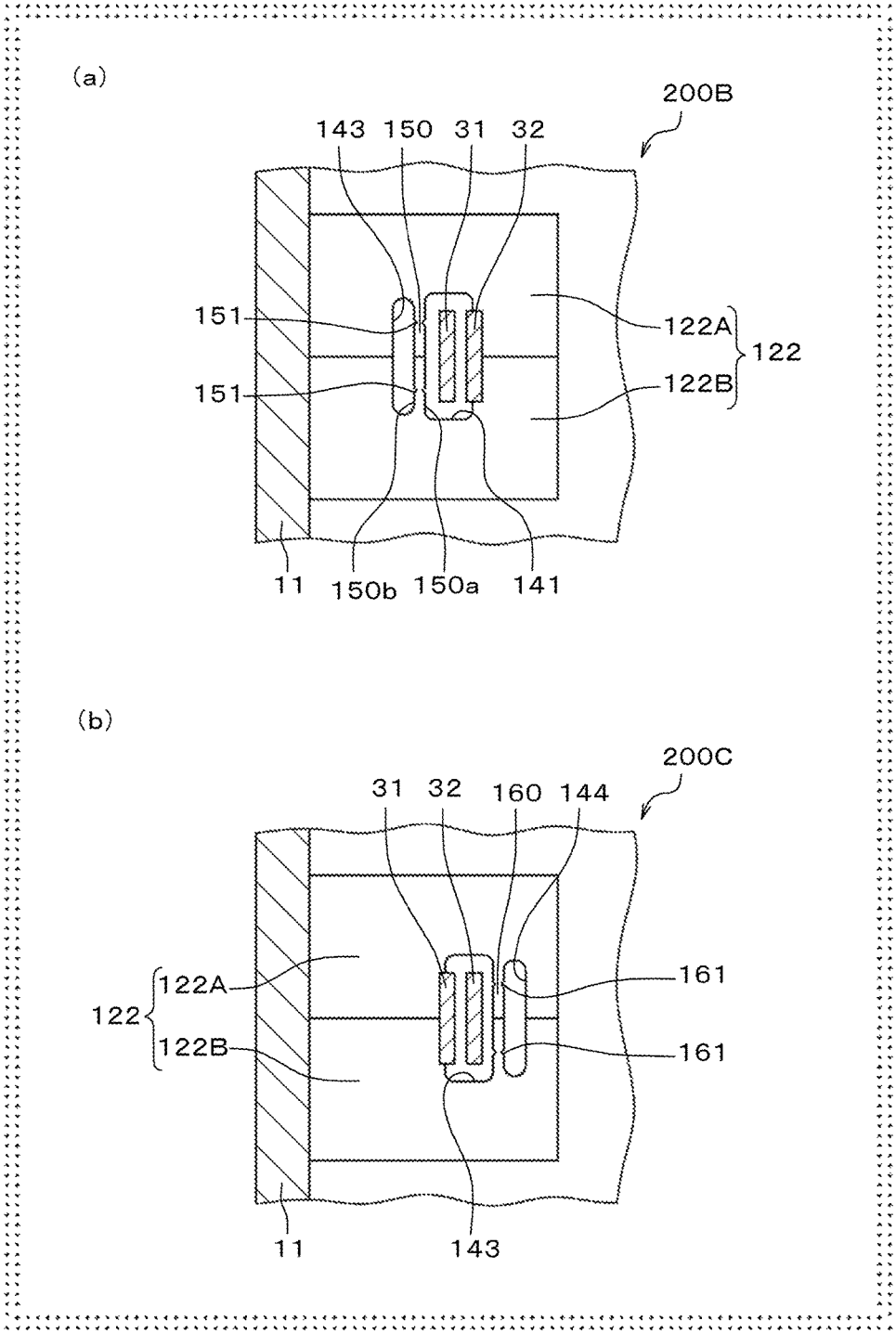

MAGNETRON AND METHOD OF ADJUSTING RESONANCE FREQUENCY OF MAGNETRON

CROSS-REFERENCE TO RELATED APPLICATION

This application is based upon and claims priority from the Japanese Patent Application No. JP2016-097158, filed on May 13, 2016, the entire contents of which are incorporated herein by reference.

BACKGROUND OF THE INVENTION

1. Field of the Invention

The present invention relates to a magnetron which is an electron tube generating microwaves, and a method of adjusting a resonance frequency of the magnetron.

2. Description of the Related Art

A magnetron is used as a high frequency generation source in an electric apparatus using microwaves, such as a microwave heater or a microwave discharge lamp. A magnetron is configured to include a vacuum tube portion disposed at the center thereof; a cooling portion located on an outer circumference of the vacuum tube portion; a pair of annular magnets disposed on the same axis as the vacuum tube portion; a yoke magnetically coupling the annular magnets; and a filter circuit portion. There are magnetrons which operate, for example, at fundamental frequencies of 2450 MHz and 915 MHz.

A resonance frequency of a magnetron is determined in a stage in which an anode cylinder, a tabular vane, and a pressure-equalizing ring (strap ring) are fixed. In a case where a resonance frequency is desired to be adjusted, there is a method or the like of adjusting a resonance frequency by striking and distorting the pressure-equalizing ring after fixing. The method of distorting the pressure-equalizing ring cannot be said to be a favorable method in terms of reliability, and may cause deterioration in characteristics depending on a distortion amount. In a case of a hard pressure-equalizing ring or a thick pressure-equalizing ring, it is hard to distort the ring, and thus a resonance frequency cannot be easily adjusted.

PTL 1 discloses a magnetron including an anode cylinder and a plurality of tabular vanes disposed radially in the anode cylinder, in which the tabular vanes are alternately connected to each other via a pressure-equalizing ring, and the magnetron has structure in which a protrusion facing the pressure-equalizing ring which is not connected to a tabular vane is provided at the tabular vane, and the protrusion is deformed so that a capacity between the tabular vane and the pressure-equalizing ring which is not connected to the tabular vane is changed, and thus an oscillation frequency is adjusted.

CITATION LIST

Patent Literature

PTL 1: JP-A-1989-132032

SUMMARY OF INVENTION

However, in the magnetron disclosed in PTL 1, in a case of adjusting an oscillation frequency by deforming the protrusion, there is a problem in that it cannot be specified to what extent a resonance frequency is adjusted if to what extent the protrusion is deformed, and adjustment requires the time and effort. Actually, skill is required for deformation adjustment of the protrusion.

The present invention has been made in consideration of these circumstances, and an object thereof is to provide a magnetron whose resonance frequency is easily adjusted and a method of adjusting a resonance frequency of the magnetron.

Solution to Problem

In order to solve the above-described problem, according to the present invention, there is provided a magnetron including an anode cylinder that extends in a cylindrical shape along a central axis; a plurality of tabular vanes each of which has at least one end fixed to the anode cylinder and that extend toward the central axis from an inner surface of the anode cylinder; and one or a plurality of pressure-equalizing rings that are disposed coaxially with respect to the central axis of the anode cylinder, in which each of the tabular vanes includes a protrusion that faces the pressure-equalizing ring in an axial direction of the anode cylinder, and one or a plurality of notches that serve as base points for deforming the protrusion toward the pressure-equalizing ring side or an opposite side to the pressure-equalizing ring.

Advantageous Effects of Invention

According to the present invention, it is possible to provide a magnetron whose resonance frequency is easily adjusted and a method of adjusting a resonance frequency of the magnetron.

BRIEF DESCRIPTION OF DRAWINGS

FIG. 1 is a diagram illustrating a configuration of a magnetron according to a first embodiment of the present invention.

FIG. 2 is a view in which an anode portion of the magnetron according to the first embodiment is viewed from an upper surface side.

FIG. 3 is a sectional view for explaining structures of first to third grooves and a protrusion formed in a tabular vane of the magnetron according to the first embodiment, in which FIG. 3(*a*) is a sectional view of the tabular vane, and FIG. 3(*b*) is an enlarged view of the protrusion.

FIG. 4 is a diagram illustrating examples of adjusting a resonance frequency of the magnetron according to the first embodiment, in which FIGS. 4(*a*) to 4(*c*) illustrate adjustment examples in which the protrusion is deformed toward a pressure-equalizing ring side with a notch as a base point, and FIGS. 4(*d*) to 4(*f*) illustrate adjustment examples in which the protrusion is deformed toward an opposite side to the pressure-equalizing ring with the notch as a base point.

FIG. 5 is a diagram illustrating a modification example of the magnetron according to the first embodiment, in which FIG. 5(*a*) illustrates an example in which a fourth groove and a protrusion are provided, and FIG. 5(*b*) illustrates an example in which the tabular vane illustrated in FIG. 3 is combined with a tabular vane illustrated in FIG. 5(*a*).

FIG. 6 is a diagram illustrating a configuration of a magnetron according to a second embodiment of the present invention.

FIG. 7 is a diagram illustrating examples of adjusting a resonance frequency of the magnetron according to the second embodiment, in which FIG. 7(*a*) illustrates an adjustment example in which a partition is deformed toward a pressure-equalizing ring side, and FIG. 7(*b*) illustrates an adjustment example in which the partition is deformed toward an opposite side to the pressure-equalizing ring.

FIG. 8 is a diagram illustrating a modification example of the magnetron according to the second embodiment.

FIG. 9 is a diagram illustrating a modification example of the magnetron according to the second embodiment, in which FIG. 9(*a*) illustrates an example in which a notch is provided in a partition, and FIG. 9(*b*) illustrates an example in which a notch is provided in another partition.

DETAILED DESCRIPTION OF THE PREFERRED EMBODIMENTS

Hereinafter, embodiments of the present invention will be described in detail with reference to the drawings.

(First Embodiment)

FIG. 1 is a diagram illustrating a configuration of a magnetron according to a first embodiment of the present invention. FIG. 2 is a view in which an anode portion of the magnetron according to the first embodiment is viewed from an upper surface side. The magnetron of the present embodiment corresponds to an example of being applied to a magnetron used for, for example, an industrial microwave oscillation apparatus.

As illustrated in FIG. 1, a magnetron 100 includes a vacuum tube portion 1 disposed at the center; a cooling portion 2 disposed on an outer circumference of the vacuum tube portion 1; a pair of annular magnets 3 disposed on the same axis as the vacuum tube portion 1; a pair of frame-shaped yokes 4 magnetically coupling the annular magnets 3 to each other; a filter circuit portion 5; and an output portion 6. The filter circuit portion 5 includes a choke coil (not illustrated). The output portion 6 includes an antenna 7, an exhaust tube (not illustrated), an antenna cover 8, and an insulator 9.

As illustrated in FIGS. 1 and 2, the vacuum tube portion 1 includes a cylindrical anode cylinder 11; a cathode 12 which is disposed on the same axis as the anode cylinder 11 and is a thermionic electron emission source; a pair of end hats 13 and 14; a plurality of tabular vanes 21 and 22 disposed radially around a central axis 10 of the anode cylinder 11; a plurality of pressure-equalizing rings 31 and 32 for alternately electrically connecting the tabular vanes 21 and 22 to each other; and the antenna 7 for emitting microwaves, whose end is connected to either one of the tabular vanes 21 and 22. The anode cylinder 11 extends along the central axis 10 in a cylindrical shape. The antenna 7 has a bar shape made of copper, and is derived from either one of the tabular vanes 21 and 22. The antenna 7 extends in the output portion 6 on the central axis 10, and a front end thereof is held by and fixed to the exhaust tube (not illustrated). The entire exhaust tube is covered with the antenna cover 8.

The tabular vanes 21 and 22 are fixed onto an inner wall surface of the anode cylinder 11, and are disposed radially around the central axis 10.

The tabular vanes 21 and 22 extend substantially radially from the vicinity of the central axis 10, and are fixed onto an inner surface of the anode cylinder 11. Each of the tabular vanes 21 and 22 is formed in a substantially rectangular plate shape. End surfaces (free ends) 21*a* and 22*a* of the tabular vanes 21 and 22 which are not fixed onto the inner surface of the anode cylinder 11 are disposed on the same cylindrical plane extending along the central axis 10, and this cylindrical plane is referred to as a vane inscribed cylinder. The plurality of tabular vanes 21 and 22 are connected to each other via the pair of small and large pressure-equalizing rings 31 and 32 which are soldered to ends of the vanes on output sides (an upper side in FIG. 1) in a circumferential direction every other vane. The tabular vanes 21 and 22 are also connected to each other via the pair of small and large pressure-equalizing rings 31 and 32 which are soldered to ends of the vanes on input sides (a lower side in FIG. 1) in a circumferential direction every other vane. The pressure-equalizing rings 31 and 32 electrically alternately connect the tabular vanes 21 and 22 to each other. A resonance frequency of the magnetron also changes depending on a soldering state of the tabular vanes 21 and 22.

Hereinafter, the vanes coupled to each other via the same pressure-equalizing rings are respectively referred to as first tabular vanes 21 and the second tabular vanes 22. When the pressure-equalizing rings 31 and 32 on the input side are referred to as first pressure-equalizing rings, tabular vanes coupled to the first pressure-equalizing rings 31 and 32 are referred to as the first tabular vanes 21. When the pressure-equalizing rings 31 and 32 on the output side are referred to as second pressure-equalizing rings, tabular vanes coupled to the second pressure-equalizing rings 31 and 32 are referred to as the second tabular vanes 22. In the present embodiment, a pressure-equalizing ring having a small diameter is a second pressure-equalizing ring 32, and a pressure-equalizing ring having a large diameter is a first pressure-equalizing ring 31. On the input side, the first tabular vanes 21 are coupled to each other, and the second tabular vanes 22 are coupled to each other, via pressure-equalizing rings reverse in sizes to the output side. In other words, a pressure-equalizing ring having a small diameter is a second pressure-equalizing ring 32 coupling the second tabular vanes 22 to each other, and a pressure-equalizing ring having a large diameter is a first pressure-equalizing ring 31 coupling the first tabular vanes 21 to each other.

As illustrated in FIG. 1, the cathode 12 has a spiral shape, and is disposed on the central axis 10 of the anode cylinder 11. Both ends of the cathode 12 are respectively fixed to the end hats 13 and 14. The end hats 13 and 14 are disposed outside of the central axis 10 with respect to the tabular vanes 21 and 22.

The magnet 3 and the frame-shaped yokes 4 are disposed to surround such oscillation portion main body, and form a magnetic circuit. The cooling portion 2 for cooling the oscillation portion main body is provided inside a space surrounded by the frame-shaped yokes 4. The cathode 12 is connected to the filter circuit 5 having a coil and a penetration capacitor (not illustrated) via a support rod (not illustrated).

As illustrated in FIGS. 1 and 2, the magnetron 100 includes a first groove 41 which is formed on first end surfaces (end surfaces on which the first groove 41 is formed) 21*b* and 22*b* of the tabular vanes 21 and 22 and is not in contact with the first pressure-equalizing ring 31; a second groove 42 which is formed on second end surfaces (end surfaces on which the second groove 42 is formed) 21*c* and 22*c* opposite to the first end surfaces 21*b* and 22*b* and is not in contact with the second pressure-equalizing ring 32; a third groove 43 (a slit which is substantially parallel to the pressure-equalizing ring) which is formed on the first end surfaces 21*b* and 22*b* of the tabular vanes 21 and 22 and is formed to be adjacent to the first groove 41 on an outer circumferential side of the anode cylinder 11; and a protrusion 50 which is formed between the first groove 41 and the third groove 43 and faces the first pressure-equalizing ring 31.

The protrusion 50 is a protrusion which is deformed when applied with force so as to adjust a resonance frequency. In the present embodiment, the protrusion 50 protrudes as a result of forming the third groove 43 which is a groove for adjusting a resonance frequency outside the first groove 41 (the outer circumferential side of the anode cylinder 11). The protrusion 50 may be formed according to any method.

FIG. 3 is a sectional view for explaining structures of the first to third grooves 41 to 43 and the protrusion 50 formed in the tabular vanes 21 and 22. FIG. 3(*a*) is a sectional view of the tabular vane 22, and FIG. 3(*b*) is an enlarged view of the protrusion 50 illustrated in FIG. 3(*a*).

As illustrated in FIG. 3, the protrusion 50 has notches 51 to 53 formed on both of a surface 50*a* facing the first pressure-equalizing ring 31 and an opposite surface 50*b* thereto. The notches 51 to 53 are notches which are base points for deforming the protrusion 50 toward the first pressure-equalizing ring 31 side or an opposite side thereto. The notches 51 to 53 are formed three in number at predetermined intervals in a height direction from a bottom of the protrusion 50. In the present embodiment, the notches 51 to 53 are, for example, V-shaped grooves but may be U-shaped grooves. The notches 51 to 53 are marks used when force is applied, and are bent at predefined positions when force is applied. In other words, the protrusion 50 has the three notches 51 to 53 at predetermined intervals in the height direction, and, in a case where the protrusion 50 is deformed, the protrusion 50 may be bent with any notch position (for example, the notch 51) among the notches 51 to 53 as a base point.

Since the protrusion 50 can be bent with the notches 51 to 53 as base points, it is possible to improve deformation workability, and to define an amount of deformation due to bending.

The number or an interval of notches 51 to 53 is not limited. The notches 51 to 53 may be formed on only one surface (for example, the surface 50*a*).

Next, a description will be made of a method of adjusting a resonance frequency of the magnetron 100.

There is provided a method of adjusting a resonance frequency of the magnetron 100 including the anode cylinder 11 extending in a cylindrical shape along the central axis 10, a plurality of tabular vanes 21 and 22 each having at least one end fixed to the anode cylinder 11 and extending toward the central axis 10 from the inner surface of the anode cylinder 11, and one or a plurality of pressure-equalizing rings 31 and 32 disposed coaxially with respect to the central axis 10 of the anode cylinder 11, the method including a step of forming the protrusions 50 facing the pressure-equalizing rings 31 and 32 in the tabular vanes 21 and 22 in an axial direction of the anode cylinder 11; and a step of forming notches serving as base points for deforming the protrusions 50, in which, in a case where a resonance frequency of the magnetron is adjusted, the protrusions 50 are deformed toward the pressure-equalizing rings 31 and 32 sides or opposite sides thereto with the notches 51 to 53 as base points.

In the present embodiment, the notches 51 to 53 or 61 to 63 have a plurality of grooves formed at predetermined intervals from base parts of the protrusions 50 or 60, any one of the plurality of grooves is selected according to an adjustment amount of a resonance frequency, and the protrusions 50 or 60 are deformed toward the pressure-equalizing rings 31 and 32 sides or opposite sides thereto with the selected groove as a base point.

FIG. 4 is a diagram illustrating examples of adjusting a resonance frequency of the magnetron 100, in which FIGS. 4(*a*) to 4(*c*) illustrate adjustment examples in which the protrusion 50 is deformed toward a pressure-equalizing ring side with the notches 51 to 53 as base points, and FIGS. 4(*d*) to 4(*f*) illustrate adjustment examples in which the protrusion 50 is deformed toward an opposite side to the pressure-equalizing ring with the notches 51 to 53 as base points. In FIG. 4, "great", "intermediate", and "small" added to arrows indicate the extent of adjustment.

As illustrated in FIGS. 4(*a*) to 4(*c*), the protrusion 50 is bent with the notches 51 to 53 as base points so as to come close to the first pressure-equalizing ring 31 side (inner circumferential side), and thus a resonance frequency (oscillation frequency) can be increased by changing a capacity between a tabular vane and a pressure-equalizing ring which is not connected to the tabular vane. Here, the protrusion 50 is provided with the notches 51 to 53 as described above. The notch 51 is formed further toward the base part of the protrusion 50 than the notches 52 and 53, the notch 52 is formed apart from the notch 51 with a predetermined distance, and the notch 53 is further formed apart from the notch 52 with a predetermined distance. In other words, the notches 51 to 53 are formed apart from the base part of the protrusion 50 at the predetermined intervals. In a case of performing adjustment for increasing a resonance frequency to the greatest extent, the protrusion 50 is bent with the notch 51 as a base point so as to come close to the first pressure-equalizing ring 31 side. As illustrated in FIG. 4(*a*), if the protrusion 50 is bent with the notch 51 as a base point, the approximately whole of the protrusion 50 comes close to the first pressure-equalizing ring 31, and thus a facing area is the largest, and a distance therebetween is reduced. Therefore, it is possible to perform adjustment for increasing a resonance frequency to the greatest extent. For example, in a case where the protrusion is bent with the notch 51 as a base point, adjustment for increasing a resonance frequency by about 5 MHz can be performed. In other words, if the notch 51 has only to be selected from among the notches 51 to 53 and be bent, the largest adjustment amount (adjustment allowance) can be ensured. The adjustment amount is a value (for example, about 5 MHz) which is appropriately determined at the time of selecting the notch 51. Since an adjustment amount of a resonance frequency can be immediately specified, the time and effort for adjustment are not required, and thus workability is considerably improved.

In a case of performing adjustment for increasing a resonance frequency to the intermediate extent, the protrusion 50 is bent with the notch 52 as a base point so as to come close to the first pressure-equalizing ring 31 side. As illustrated in FIG. 4(*b*), if the protrusion 50 is bent with the notch 52 as a base point, the protrusion 50 is bent from the approximately intermediate position thereof so as to come close to the first pressure-equalizing ring 31, and thus it is possible to perform adjustment for increasing a resonance frequency to the intermediate extent (adjustment for increasing a resonance frequency by about 3 MHz).

In a case of performing adjustment for increasing a resonance frequency to the smallest extent, the protrusion 50 is bent with the notch 53 as a base point so as to come close to the first pressure-equalizing ring 31 side. As illustrated in FIG. 4(*c*), if the protrusion 50 is bent with the notch 53 as a base point, the protrusion 50 is bent from the upper position thereof so as to come close to the first pressure-equalizing ring 31, and thus a facing area is the smallest. Therefore, it is possible to perform adjustment for increasing a resonance frequency to the smallest extent (adjustment for increasing a resonance frequency by about 1 MHz).

The above description relates to examples of increasing a resonance frequency. In a case where a resonance frequency is reduced, the protrusion 50 may be bent to come close to an opposite side (outer circumferential side) to the first pressure-equalizing ring 31.

In other words, in a case of performing adjustment for reducing a resonance frequency to the greatest extent, the protrusion 50 is bent toward the opposite side to the first pressure-equalizing ring 31 with the notch 51 as a base point so as to become distant from the first pressure-equalizing ring 31. As illustrated in FIG. 4(*d*), if the protrusion 50 is bent toward the opposite side to the first pressure-equalizing ring 31 with the notch 51 as a base point, the approximately whole of the protrusion 50 becomes distant from the first pressure-equalizing ring 31, and thus a facing area is the smallest, and a distance therebetween is increased. Therefore, it is possible to perform adjustment for reducing a resonance frequency to the greatest extent. For example, in a case where the protrusion is bent toward the opposite side to the first pressure-equalizing ring 31 with the notch 51 as a base point, adjustment for reducing a resonance frequency by about 5 MHz can be performed.

In a case of performing adjustment for reducing a resonance frequency to the intermediate extent, the protrusion 50 is bent toward the opposite side of the first pressure-equalizing ring 31 with the notch 52 as a base point so as to become distant from the first pressure-equalizing ring 31. As illustrated in FIG. 4(*e*), if the protrusion 50 is bent toward the opposite side of the first pressure-equalizing ring 31 with the notch 52 as a base point, the protrusion 50 is bent from the approximately intermediate position thereof so as to become distant from the first pressure-equalizing ring 31, and thus it is possible to perform adjustment for reducing a resonance frequency to the intermediate extent (adjustment for reducing a resonance frequency by about 3 MHz).

In a case of performing adjustment for reducing a resonance frequency to the smallest extent, the protrusion 50 is bent toward the opposite side of the first pressure-equalizing ring 31 with the notch 53 as a base point so as to become distant from the first pressure-equalizing ring 31 side. As illustrated in FIG. 4(*f*), if the protrusion 50 is bent toward the opposite side of the first pressure-equalizing ring 31 with the notch 53 as a base point, the protrusion 50 is bent from the upper position thereof so as to become distant from the first pressure-equalizing ring 31, and thus a facing area is the largest. Therefore, it is possible to perform adjustment for reducing a resonance frequency to the smallest extent (adjustment for reducing a resonance frequency by about 1 MHz).

As mentioned above, if an appropriate notch has only to be selected from among the notches 51 to 53 and be bent, a desired adjustment amount (adjustment allowance) can be ensured. Since an adjustment amount of a resonance frequency can be immediately specified, the time and effort for adjustment are not required, and thus workability is considerably improved.

As described above, the magnetron 100 according to the present embodiment includes the anode cylinder 11 extending in a cylindrical shape along the central axis 10, a plurality of tabular vanes 21 and 22 each having at least one end fixed to the anode cylinder 11 and extending toward the central axis 10 from the inner surface of the anode cylinder 11, and pressure-equalizing rings 31 and 32 disposed coaxially with respect to the central axis 10 of the anode cylinder 11, and electrically connecting the tabular vanes 21 and 22 to each other every other vane. The tabular vanes 21 and 22 include the protrusions 50 facing the pressure-equalizing rings 31 and 32 in a direction of the central axis 10 of the anode cylinder 11, and the notches 51 to 53 serving as base points for deforming the protrusions 50 toward the pressure-equalizing rings 31 and 32 sides or opposite sides thereto. The protrusion 50 is a columnar protrusion formed by providing a slit which is substantially parallel to the pressure-equalizing rings 31 and 32 in an axial direction of the anode cylinder 11. The notch 51 is a groove formed from a base part of the protrusion 50 at a predetermined interval.

A method of adjusting a resonance frequency of the magnetron 100 includes a step of forming the protrusions 50 facing the pressure-equalizing rings 31 and 32 in the tabular vanes 21 and 22 in an axial direction of the anode cylinder 11; and a step of forming the notches 51 to 53 serving as base points for deforming the protrusions 50, in which the protrusions 50 are deformed toward the pressure-equalizing rings 31 and 32 sides or opposite sides thereto with the notches 51 to 53 as base points. The tabular vanes 21 and 22 are made of copper (oxygen-free copper or the like), and can thus be bent and be also returned to an original state.

With these configuration and method, an adjustment amount (adjustment allowance) of a resonance frequency of the magnetron 100 can be determined by selecting an appropriate notch from among the notches 51 to 53. In other words, if an appropriate notch has only to be selected from among the notches 51 to 53 and be bent, a desired adjustment amount (adjustment allowance) can be ensured. Since an adjustment amount of a resonance frequency can be immediately specified, the time and effort for adjustment are not required, and thus workability is considerably improved. A person performing the work is not required to have skill. As a result, it is possible to reduce cost.

Since the present embodiment does not employ a method in which the anode cylinder 11, the tabular vanes 21 and 22, and the pressure-equalizing rings 31 and 32 are fixed, and then a resonance frequency is adjusted by hitting and distorting the pressure-equalizing rings 31 and 32, reliability is not degraded. Particularly, there is concern that characteristics may deteriorate depending on a distortion amount, but such characteristic deterioration can be prevented in advance. In a case of a hard pressure-equalizing ring or a thick pressure-equalizing ring, it is hard to distort the ring, and thus a resonance frequency cannot be easily adjusted, but this problem can also be prevented.

In the present embodiment, even a pressure-equalizing ring which is hardly deformed can be used to easily adjust a resonance frequency without degrading reliability. It is easy to increase a resonance frequency and then reduce the resonance frequency, and also to reduce a resonance frequency and then increase the resonance frequency.

[Modification Example]

FIG. 5 is a diagram illustrating Modification Example 1 of the magnetron according to the first embodiment, and illustrates the tabular vane 22 as a representative of the tabular vanes 21 and 22 illustrated in FIG. 1.

As illustrated in FIG. 5(*a*), a magnetron 100A includes a first groove 41 which is formed on a first end surface 22*b* of the tabular vane 22 and is not in contact with a first pressure-equalizing ring 31; a second groove 42 which is formed on a second end surface 22*c* opposite to the first end surface 22*b* and is not in contact with a second pressure-equalizing ring 32; a fourth groove 44 (a slit which is substantially parallel to the pressure-equalizing ring) which is formed on the second end surface 22*c* of the tabular vane 22 and is formed to be adjacent to the second groove 42 on an inner circumferential side of an anode cylinder 11; and a protrusion 60 which is formed between the second groove 42 and the fourth groove 44 and faces the second pressure-equalizing ring 32.

The protrusion 60 is a protrusion which is deformed when applied with force so as to adjust a resonance frequency. In the present embodiment, the protrusion 60 protrudes as a result of forming the fourth groove 44 which is a groove for adjusting a resonance frequency inside the second groove 42 (the inner circumferential side of the anode cylinder 11). The protrusion 60 may be formed according to any method.

As illustrated in FIG. 5(*b*), the magnetron 100B is obtained by combining the tabular vane 22 illustrated in FIG. 3 with the tabular vane 22 illustrated in FIG. 5(*a*).

In the tabular vane 22 of the magnetron 100A or 100B of the modification example, the protrusion 60 is provided with notches 61 to 63 serving as base points for deforming the protrusion toward the pressure-equalizing rings 31 and 32 sides or opposite sides thereto, and, in a case of adjusting a resonance frequency of the magnetron 100A or 100B, the protrusion 60 is deformed toward the pressure-equalizing rings 31 and 32 sides or the opposite sides thereto with the notches 61 to 63 as base points.

With these configuration and method, in the same manner as in the case of the magnetron 100, if an appropriate notch has only to be selected from among the notches 61 to 63 and be bent, a desired adjustment amount (adjustment allowance) can be ensured. The magnetron 100B illustrated in FIG. 5(*b*) includes two protrusions, that is, the protrusion 50 (with the notches 51 to 53) and the protrusion 60 (with the notches 61 to 63), and thus the number of protrusions 50 and 60 related to adjustment can be increased to twice the number of protrusions of the magnetron 100 illustrated in FIG. 1. By increasing the number of protrusions 50 and 60 related to adjustment, an adjustment amount (adjustment allowance) per protrusion can be reduced, and thus more uniform adjustment can be performed as a whole. Since the number of protrusions 50 and 60 related to adjustment is increased, the number of options from among which an adjustment target is selected is increased, and thus there is an effect of improving workability.

(Second Embodiment)

FIG. 6 is a diagram illustrating a configuration of a magnetron according to a second embodiment of the present invention. The same constituent elements as those in FIG. 1 are given the same reference numerals, and description of repeated locations will be omitted.

As illustrated in FIG. 6, a magnetron 200 includes a cylindrical anode cylinder 11; a cathode 12 which is disposed on the same axis as the anode cylinder 11; a pair of end hats 13 and 14; a plurality of tabular vanes 121 and 122 disposed radially around a central axis 10 of the anode cylinder 11; a plurality of pressure-equalizing rings (strap rings) 31 and 32 for alternately electrically connecting the tabular vanes 121 and 122 to each other; and the antenna 7 for emitting microwaves, whose end is connected to either one of the tabular vanes 121 and 122.

The tabular vanes 121 and 122 are disposed radially around the central axis 10, and are fixed onto an inner wall surface of the anode cylinder 11. Each of the tabular vanes 121 and 122 is formed in a substantially rectangular plate shape.

Each of the tabular vanes 121 and 122 is a combined vane which is integrally formed by vertically combining two tabular vanes with each other. For example, the tabular vane 121 is formed of a combination of an upper (output side) vane 121A and a lower (input side) vane 121B. The tabular vane 122 is formed of a combination of an upper (output side) vane 122A and a lower (input side) vane 122B. Each of the tabular vanes 121 and 122 is a single tabular vane obtained by combining the two upper and lower tabular vanes with each other. The tabular vanes 121 and 122 have a configuration of vertically combining two tabular vanes with each other, and thus a penetration hole (which will be described later) can be easily formed in the tabular vane. The pressure-equalizing rings 31 and 32 can be made to easily pass through the penetration hole.

End surfaces (free ends) 121*a* and 122*a* of the tabular vanes 121 and 122 which are not fixed onto the inner surface of the anode cylinder 11 are disposed on the same cylindrical plane extending along the central axis 10, and this cylindrical plane is referred to as a vane inscribed cylinder. The plurality of tabular vanes 121 and 122 are connected to each other via the pair of small and large pressure-equalizing rings 31 and 32 which are soldered to ends of the vanes on output sides (an upper side in FIG. 6) in a circumferential direction every other vane. The tabular vanes 121 and 122 are also connected to each other via the pair of small and large pressure-equalizing rings 31 and 32 which are soldered to ends of the vanes on input sides (a lower side in FIG. 6) in a circumferential direction every other vane. The pressure-equalizing rings 31 and 32 electrically alternately connect the tabular vanes 121 and 122 to each other.

Hereinafter, the vanes coupled to each other via the same pressure-equalizing rings are respectively referred to as first tabular vanes 121 and the second tabular vanes 122. A pressure-equalizing ring on the output side, connecting the first tabular vanes 121 is referred to as a first pressure-equalizing ring 31, and a pressure-equalizing ring on the output side, coupling the second tabular vanes 122 to each other is referred to as a second pressure-equalizing ring 32. In the present embodiment, a pressure-equalizing ring having a small diameter is the second pressure-equalizing ring 32, and a pressure-equalizing ring having a large diameter is the first pressure-equalizing ring 31.

The magnetron 200 includes first penetration holes 141 which are formed to penetrate through the tabular vanes 121 and 122 in a circumferential direction, to be in contact with the second pressure-equalizing ring 32, and not to be in contact with the first pressure-equalizing ring 31; second penetration holes 142 which are formed to penetrate through the tabular vanes 121 and 122 in the circumferential direction and to be adjacent to the first penetration holes 141 on outer circumferential sides of the first penetration holes 141; and partitions 150 which are formed between the first penetration holes 141 and the second penetration holes 142 and face the first pressure-equalizing ring 31.

The partition 150 is a partition plate which is deformed toward the first pressure-equalizing ring 31 side disposed in the first penetration hole 141 or an opposite side thereto when applied with force so as to adjust a resonance frequency. In the present embodiment, the partition 150 is formed by forming a partition plate between the first penetration hole 141 and the second penetration hole 142 as a result of forming the second penetration hole 142 outside the first penetration hole 141 (the outer circumferential side of the anode cylinder 11).

Next, a description will be made of a method of adjusting a resonance frequency of the magnetron 200.

There is provided a method of adjusting a resonance frequency of the magnetron 200 including the anode cylinder 11 extending in a cylindrical shape along the central axis 10, a plurality of tabular vanes 121 and 122 each having at least one end fixed to the anode cylinder 11 and extending toward the central axis 10 from the inner surface of the anode cylinder 11, and one or a plurality of pressure-equalizing rings 31 and 32 disposed coaxially with respect to the central axis 10 of the anode cylinder 11, the method including a step of forming the first penetration holes which penetrate through the tabular vanes 121 and 122 in a circumferential direction and are not in contact with the pressure-equalizing rings 31 and 32; a step of forming the second penetration holes which penetrate through the tabular vanes 121 and 122 in the circumferential direction and are adjacent to the first penetration holes; and a step of forming the partitions 150 facing the pressure-equalizing rings 31 and 32 disposed in the first penetration holes between the first penetration holes and the second penetration holes, in which, in a case where a resonance frequency of the magnetron is adjusted, the partitions 150 are deformed toward the pressure-equalizing rings 31 and 32 sides disposed in the first penetration holes or opposite sides thereto.

FIG. 7 is a diagram illustrating examples of adjusting a resonance frequency of the magnetron 200, in which FIG. 7(*a*) illustrates an adjustment example in which the partition 150 is deformed toward a pressure-equalizing ring side, and FIG. 7(*b*) illustrates an adjustment example in which the partition 150 is deformed toward an opposite side to the pressure-equalizing ring.

As illustrated in FIG. 7(*a*), in a case of performing adjustment for increasing a resonance frequency, the partition 150 is bent toward the first pressure-equalizing ring 31 side so as to come close to the first pressure-equalizing ring 31 side. If the partition 150 comes close to the first pressure-equalizing ring 31 side, a resonance frequency can be increased by changing a capacity between a tabular vane and a pressure-equalizing ring which is not connected to the tabular vane.

As illustrated in FIG. 7(*b*), in a case of performing adjustment for reducing a resonance frequency, the partition 150 is bent toward the opposite side of the first pressure-equalizing ring 31 so as to become distant from the first pressure-equalizing ring 31. If the partition 150 becomes distant from the first pressure-equalizing ring 31, a resonance frequency can be reduced.

As mentioned above, the magnetron 200 according to the present embodiment includes the anode cylinder 11 extending in a cylindrical shape along the central axis 10; a plurality of tabular vanes 121 and 122 each having at least one end fixed to the anode cylinder 11 and extending toward the central axis 10 from the inner surface of the anode cylinder 11; the pressure-equalizing rings 31 and 32 disposed coaxially with respect to the central axis 10 of the anode cylinder 11 and alternately electrically connecting the tabular vanes 121 and 122 to each other; the first penetration holes 141 which are formed to penetrate through the tabular vanes 121 and 122 in a circumferential direction and not to be in contact with the pressure-equalizing rings 31 and 32; the second penetration holes 142 which are formed to penetrate through the tabular vanes 121 and 122 in the circumferential direction and to be adjacent to the first penetration holes 141; and the partitions 150 which are formed between the first penetration holes 141 and the second penetration holes 142 and face the pressure-equalizing rings 31 and 32 disposed in the first penetration holes 141. Each of the tabular vanes 121 or 122 is formed of a combination of the upper (output side) vane 121A and the lower (input side) vane 121B.

There is provided a method of adjusting a resonance frequency of the magnetron 200 including a step of forming the first penetration holes 141 which penetrate through the tabular vanes 121 and 122 in a circumferential direction and are not in contact with the pressure-equalizing rings 31 and 32; a step of forming the second penetration holes 142 which penetrate through the tabular vanes 121 and 122 in the circumferential direction and are adjacent to the first penetration holes; and a step of forming the partitions 150 facing the pressure-equalizing rings 31 and 32 disposed in the first penetration holes 141 between the first penetration holes 141 and the second penetration holes 142, in which, in a case where a resonance frequency of the magnetron 200 is adjusted, the partitions 150 are deformed toward the pressure-equalizing rings 31 and 32 sides disposed in the first penetration holes 141 or opposite sides thereto.

With these configuration and method, if the partition 150 has only to be bent, a resonance frequency of the magnetron 200 can be adjusted. Since the present embodiment does not employ a method in which the above-described fixation occurs, and then a resonance frequency is adjusted by hitting and distorting the pressure-equalizing rings 31 and 32 as in the example of the related art, reliability is not degraded. Particularly, there is concern that characteristics may deteriorate depending on a distortion amount, but such characteristic deterioration can be prevented in advance. In a case of a hard pressure-equalizing ring or a thick pressure-equalizing ring, it is hard to distort the ring, and thus a resonance frequency cannot be easily adjusted, but this problem can also be prevented.

In the present embodiment, even a pressure-equalizing ring which is hardly deformed can be used to easily adjust a resonance frequency without degrading reliability. It is easy to increase a resonance frequency and then reduce the resonance frequency, and also to reduce a resonance frequency and then increase the resonance frequency.

Particularly, in the present embodiment, the tabular vanes 121 and 122 are provided with the first penetration holes 141, the second penetration holes 142, and the partitions 150 facing the pressure-equalizing rings 31 and 32 disposed in the first penetration holes 141, and a resonance frequency is adjusted by deforming the partitions 150 provided in the tabular vanes 121 and 122. Therefore, there is a remarkable effect in which uniformity of an electric field of the magnetron 200 is held regardless of a method of adjusting a resonance frequency by deforming the partition 150, and thus there is no influence on the outsides of the tabular vanes 121 and 122 (especially, the input sides of the tabular vanes 121 and 122).

In the present embodiment, each of the tabular vanes 121 and 122 is a combined vane obtained by combining the upper (output side) vane 121A and the lower (input side) vane 121B, and thus there is an advantage in that the partition 150 is easily deformed at the combined portion.

[Modification Examples]

FIG. 8 is a diagram illustrating Modification Example 2 of the magnetron according to the second embodiment, and illustrates the tabular vane 122 as a representative of the tabular vanes 121 and 122 illustrated in FIG. 6.

As illustrated in FIG. 8, a magnetron 200A includes a third penetration hole 143 which is formed to penetrate through the tabular vane 122 in a circumferential direction, to be in contact with the first pressure-equalizing ring 31, and not to be in contact with the second pressure-equalizing ring 32; a fourth penetration hole 144 which is formed to penetrate through the tabular vane 122 in the circumferential direction and to be adjacent to the third penetration hole 143 on the inner circumferential side of the third penetration hole 143; and a partition 160 which is formed between the third penetration hole 143 and the fourth penetration hole 144 and faces the second pressure-equalizing ring 32.

The partition 160 is a partition plate which is deformed when applied with force so as to adjust a resonance frequency. In the present embodiment, the partition 160 is formed by forming a partition plate between the third penetration hole 143 and the fourth penetration hole 144 as a result of forming the fourth penetration hole 144 inside the third penetration hole 143 (the inner circumferential side of the anode cylinder 11).

In the magnetron 200A of Modification Example 2, in the same manner as in the case of the magnetron 200 illustrated in FIG. 6, if the partition 160 has only to be bent, a resonance frequency of the magnetron 200A can be adjusted. Even a pressure-equalizing ring which is hardly deformed can be used to easily adjust a resonance frequency without degrading reliability. It is easy to increase a resonance frequency and then reduce the resonance frequency, and also to reduce a resonance frequency and then increase the resonance frequency. In the same manner as in the case of the magnetron 200 illustrated in FIG. 6, there is a remarkable effect in which there is no influence on the outsides of the tabular vanes 122 (121) regardless of a method of adjusting a resonance frequency by deforming the partition 160.

FIG. 9 is a diagram illustrating Modification Example 3, and illustrates the tabular vane 122 as a representative of the tabular vanes 121 and 122 illustrated in FIG. 6. Modification Example 3 is an example in which the notches of the magnetron 100 according to the first embodiment are formed in the partition of the magnetron 200 according to the second embodiment.

As illustrated in FIG. 9(*a*), a partition 150 of a magnetron 200B has notches 151 formed on both of a surface 150*a* facing the first pressure-equalizing ring 31 and an opposite surface 150*b* thereto. Two notches 151 are formed at a predetermined interval vertically at a combined joint portion of the tabular vane 122. In the present embodiment, the notches 151 are, for example, V-shaped grooves but maybe U-shaped grooves. The notches 151 are marks used when force is applied, and are bent at predefined positions when force is applied. In a case where the partition 150 is deformed, the partition 150 can be bent with positions of the notches 151 as base points. It is possible to improve deformation workability, and to define an amount of deformation due to bending.

As illustrated in FIG. 9(*b*), a partition 160 of a magnetron 200C has notches 161 formed on both of a surface facing the second pressure-equalizing ring 32 and an opposite surface thereto. Two notches 161 are formed at a predetermined interval vertically at a combined joint portion of the tabular vane 122. In the present embodiment, the notches 161 are, for example, V-shaped grooves but may be U-shaped grooves. The number of notches 161 may be two or more. The notches 161 are marks used when force is applied, and are bent at predefined positions when force is applied. In a case where the partition 160 is deformed, the partition 160 can be bent with positions of the notches 161 as base points. It is possible to improve deformation workability, and to define an amount of deformation due to bending.

According to the magnetrons 200B and 200C of Modification Example 3, in addition to the effects achieved by the magnetron 200 according to the second embodiment, it is possible to more easily adjust an adjustment amount (adjustment allowance) of a resonance frequency since the partitions 150 and 160 can be bent with positions of the notches 151 and 161 as base points.

The present invention is not limited to the configurations described in the respective embodiments and modification examples, and the configurations maybe changed as appropriate within the scope without departing from the spirit of the present invention disclosed in the claims.

For example, materials, shapes, structures, and the like of the tabular vanes or the pressure-equalizing rings, the number of notches of the protrusion, and notch structures are only examples, and any other configuration may be used.

The above-described respective embodiments have been described in detail for better understanding of the present invention, and are not necessarily limited to including all of the described configurations. Some configurations of a certain embodiment may be replaced with configurations of other embodiments, and configurations of other embodiments may be added to configurations of a certain embodiment. The configurations of other embodiments may be added to, deleted from, and replaced with some of the configurations of each embodiment.

DESCRIPTION OF REFERENCE SIGNS

1 VACUUM TUBE PORTION
2 COOLING PORTION
3 ANNULAR MAGNET
4 FRAME-SHAPED YOKE
5 FILTER CIRCUIT PORTION
6 OUTPUT PORTION
10 CENTRAL AXIS
11 ANODE CYLINDER
12 CATHODE
21, 22, 121, AND 122 TABULAR VANE (FIRST TABULAR VANE, SECOND TABULAR VANE)
31 FIRST PRESSURE-EQUALIZING RING
32 SECOND PRESSURE-EQUALIZING RING
41 FIRST GROOVE
42 SECOND GROOVE
43 THIRD GROOVE (SLIT WHICH IS SUBSTANTIALLY PARALLEL TO PRESSURE-EQUALIZING RING)
44 FOURTH GROOVE (SLIT WHICH IS SUBSTANTIALLY PARALLEL TO PRESSURE-EQUALIZING RING)
50 AND 60 PROTRUSION
51 TO 53, AND 61 TO 63 NOTCH
100, 100A, 100B, 200, 200A, 200B, AND 200C MAGNETRON
121A UPPER (OUTPUT SIDE) VANE
122B LOWER (INPUT SIDE) VANE
141 FIRST PENETRATION HOLE
142 SECOND PENETRATION HOLE
143 THIRD PENETRATION HOLE
144 FOURTH PENETRATION HOLE
150 AND 160 PARTITION

The invention claimed is:

1. A magnetron comprising:

an anode cylinder that extends in a cylindrical shape along a central axis;

a plurality of tabular vanes each of which has at least one end fixed to the anode cylinder and that extend toward the central axis from an inner surface of the anode cylinder; and one or a plurality of pressure-equalizing rings that are disposed coaxially with respect to the central axis of the anode cylinder, wherein each of the tabular vanes includes:

a protrusion that faces the pressure-equalizing ring in an axial direction of the anode cylinder, and a plurality of notches that are grooves formed in a base part of the protrusion at predetermined intervals, wherein the plurality of notches are base points for deforming the protrusion toward a side of the pressure-equalizing ring or an opposite side to the pressure-equalizing ring.

2. The magnetron according to claim 1, wherein the protrusion is a columnar protrusion formed by providing a slit which is substantially parallel to the pressure-equalizing ring in the axial direction of the anode cylinder.

3. The magnetron according to claim 1, wherein the tabular vanes include:

a plurality of first tabular vanes that extend toward the central axis from the inner surface of the anode cylinder; and second tabular vanes that extend toward the central axis from the inner surface of the anode cylinder and are provided at positions interposed between the first tabular vanes, and wherein the tabular vanes which are adjacent to each other are respectively connected to different pressure-equalizing rings.

4. A magnetron comprising:

an anode cylinder that extends in a cylindrical shape along a central axis;

a plurality of tabular vanes each of which has at least one end fixed to the anode cylinder and that extend toward the central axis from an inner surface of the anode cylinder; and one or a plurality of pressure-equalizing rings that are disposed coaxially with respect to the central axis of the anode cylinder, wherein each of the tabular vanes include:

first penetration holes that are formed to penetrate through the tabular vanes in a circumferential direction and not to be in contact with the pressure-equalizing rings;

second penetration holes that are formed to penetrate through the tabular vanes in the circumferential direction and to be adjacent to the first penetration holes; and partitions that are formed between the first penetration holes and the second penetration holes and face the pressure-equalizing rings disposed in the first penetration holes, wherein the partitions are deformed toward a side of the pressure-equalizing rings disposed in the first penetration holes or opposite sides to the first penetration holes when applied with force.

5. The magnetron according to claim 4, wherein the tabular vanes are separate from each other in an axial direction of the anode cylinder.

6. The magnetron according to claim 4, wherein each of the partitions has a plurality of notches.

7. The magnetron according to claim 4, wherein the tabular vanes include:

a plurality of first tabular vanes that extend toward the central axis from the inner surface of the anode cylinder; and second tabular vanes that extend toward the central axis from the inner surface of the anode cylinder and are provided at positions interposed between the first tabular vanes, and wherein the tabular vanes which are adjacent to each other are respectively connected to different pressure-equalizing rings.

8. A method of adjusting a resonance frequency of a magnetron the method comprising:

forming protrusions facing a pressure-equalizing ring in tabular vanes in an axial direction of an anode cylinder, wherein the anode cylinder extends in a cylindrical shape along a central axis and each of a plurality of tabular vanes has at least one end fixed to the anode cylinder and extends toward the central axis from an inner surface of the anode cylinder;

forming a plurality of notches that are grooves formed in a base part of the protrusions at predetermined intervals, wherein the plurality of notches are base points for deforming the protrusions; and deforming, using the plurality of notches, the protrusions toward sides of the pressure-equalizing rings to adjust the resonance frequency of the magnetron.

9. The method of adjusting the resonance frequency of the magnetron according to claim 8, wherein any one of the plurality of notches is deformed depending on an adjustment amount of the resonance frequency.

10. A method of adjusting a resonance frequency of a magnetron including an anode cylinder that extends in a cylindrical shape along a central axis, a plurality of tabular vanes each of which has at least one end fixed to the anode cylinder and that extend toward the central axis from an inner surface of the anode cylinder, and one or a plurality of pressure-equalizing rings that are disposed coaxially with respect to the central axis of the anode cylinder, the method comprising:

a step of forming first penetration holes which penetrate through the tabular vanes in a circumferential direction and are not in contact with the pressure-equalizing rings;

a step of forming second penetration holes which penetrate through the tabular vanes in the circumferential direction and are adjacent to the first penetration holes; and a step of forming partitions which face the pressure-equalizing rings disposed in the first penetration holes between the first penetration holes and the second penetration holes, wherein, in a case where the resonance frequency of the magnetron is adjusted, the partitions are deformed toward sides of the pressure-equalizing rings disposed in the first penetration holes or opposite sides to the first penetration holes.

* * * * *